United States Patent [19]

Gamso et al.

[11] 4,188,939

[45] Feb. 19, 1980

[54] SPACE HEATER FOR USE WITH FIREPLACE

[76] Inventors: Robert Gamso; Robert A. Gamso, both of 1112 Regent St., Niles, Mich. 49120

[21] Appl. No.: 846,409

[22] Filed: Oct. 28, 1977

[51] Int. Cl.[2] ..... F24B 7/04

[52] U.S. Cl. ..... 126/121; 126/129; 126/131

[58] Field of Search ..... 126/121, 131, 129; 237/51

[56] References Cited

U.S. PATENT DOCUMENTS

| | | | |
|---|---|---|---|
| 2,359,197 | 9/1944 | Brooks | 126/121 |
| 3,866,595 | 2/1975 | Jones | 126/121 |
| 3,976,047 | 8/1976 | Breen et al. | 126/121 |
| 4,103,669 | 8/1978 | Pauley | 126/121 |

FOREIGN PATENT DOCUMENTS

| | | | |
|---|---|---|---|
| 672437 | 5/1952 | United Kingdom | 126/121 |
| 862306 | 3/1961 | United Kingdom | 126/121 |
| 1169587 | 11/1969 | United Kingdom | 126/121 |

*Primary Examiner*—Larry I. Schwartz
*Attorney, Agent, or Firm*—Marmaduke A. Hobbs

[57] ABSTRACT

A space heater for use with fireplaces in which a metal unit is adapted to be placed in the fireplace near the rear wall but spaced therefrom and being mounted on a leg-like support structure which positions the unit above the normal level of the fire so that the hot gases and smoke will circulate on both the front and the rear sides of the unit as they pass from the fire to the flue. The unit is relatively narrow in the forward and rearward directions and elongated laterally, and contains a chamber in which a series of baffles preferably direct the circulating air through in a circuitous path. An inlet is provided with a tubular conduit connecting the inlet with the front of the fireplace and an outlet with a tubular conduit connecting the outlet with the space to be heated. A blower normally placed on the intake side of the chamber causes the air to flow from the room through the chamber where it is heated and then discharged into the room. A spacer is provided on the rear side of the unit to hold the unit in spaced relation to the rear wall of the firebox and the legs may be adjustable to obtain the most optimum height of the unit above the level of the wood or other fuel in the fireplace. The unit and connecting conduits can be readily inserted in and removed from the fireplace and, when the unit is in the fireplace, the fireplace can be used in the normal manner while the unit provides additional heat to the room or other space being heated thereby.

4 Claims, 7 Drawing Figures

Fig. 1
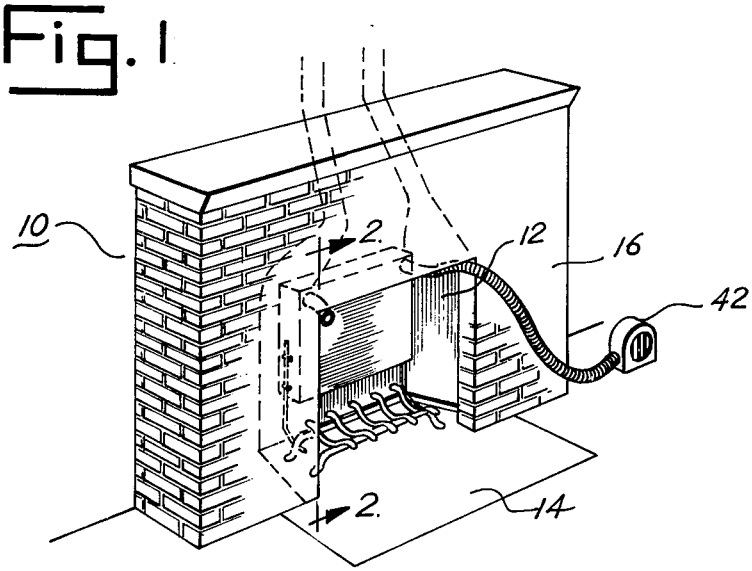
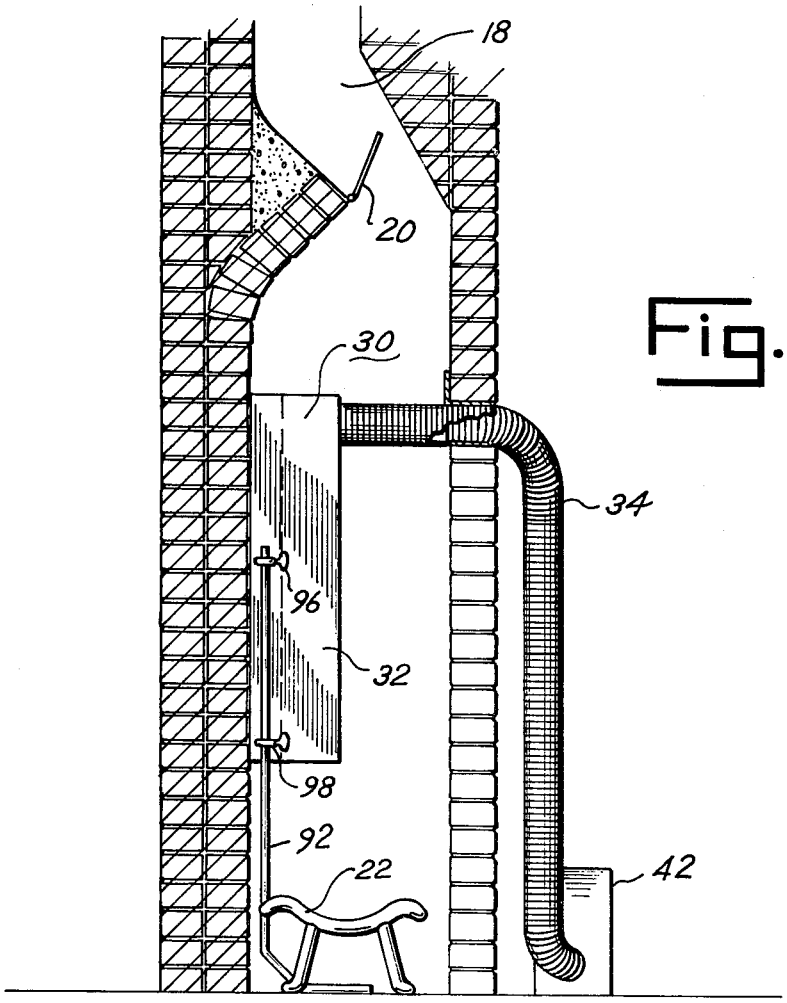
Fig. 2

SPACE HEATER FOR USE WITH FIREPLACE

A conventional fireplace is notorious for its inefficiency in heating a room or other enclosed space, in that the heating is accomplished solely by radiation, primarily from the fire and coals, and secondarily from the heated fireplace masonry and equipment supporting the logs or other fuel used in the fireplace. In attempts to improve the heating efficiency of conventional fireplaces, various types of heaters, prefabricated shells, walls and similar structures have been used, in which room air is passed through or over the structure and is heated by convection and returned to the room, frequently by a fan or blower. These structures sometimes require a special fireplace construction in which a steel shell is used and air inlet and outlet registers are provided in the fireplace masonry walls. This type of structure often detracts from the appearance of the fireplace and requires a major reconstruction operation if and when the shell burns out or is rusted through. Heaters inserted in the firebox have been tried, but these have often been inefficient and/or unsightly and have detracted from the pleasure normally derived from an open fireplace, without appreciably increasing the comfort in the room. It is therefore one of the principal objects of the present invention to provide an efficient fireplace heater which can be used as an accessory in a conventional fireplace, and which can conveniently be inserted in and removed from the fireplace, either with or without a fire in the fireplace.

Another object of the invention is to provide heaters for conventional fireplaces, which can effectively be used with or without a grate and with a variety of different fuels, and which utilize convection heating for heating circulating air from the room or other space in which the fireplace is located, without detracting from the inherent enjoyment of the fire in the fireplace.

Still another object of the invention is to provide an accessory heater for a fireplace, which can be easily lifted into and from the fireplace for temporary or permanent installations, and which is principally located above the base of the fire at the rear of the firebox in such a position that the heated gases and smoke from the fire can pass on all sides of the heater to obtain maximum heat transfer of heat to the structure, thus permitting the heater to be relatively small in size for the volume of room air heated by the structure.

A further object is to provide a fireplace heater of the aforesaid type, which can be readily installed without any special skill or equipment, and which is simple in construction and operation and can easily be maintained in a clean and efficient operating condition over long periods of use.

Additional objects and advantages of the present invention will become apparent from the following description and accompanying drawings, wherein:

FIG. 1 is a perspective view of a fireplace containing the present space heater mounted therein in operating position;

FIG. 2 is a vertical cross sectional view of the fireplace and a side elevational view of the heater mounted in the fireplace;

Figure 3:
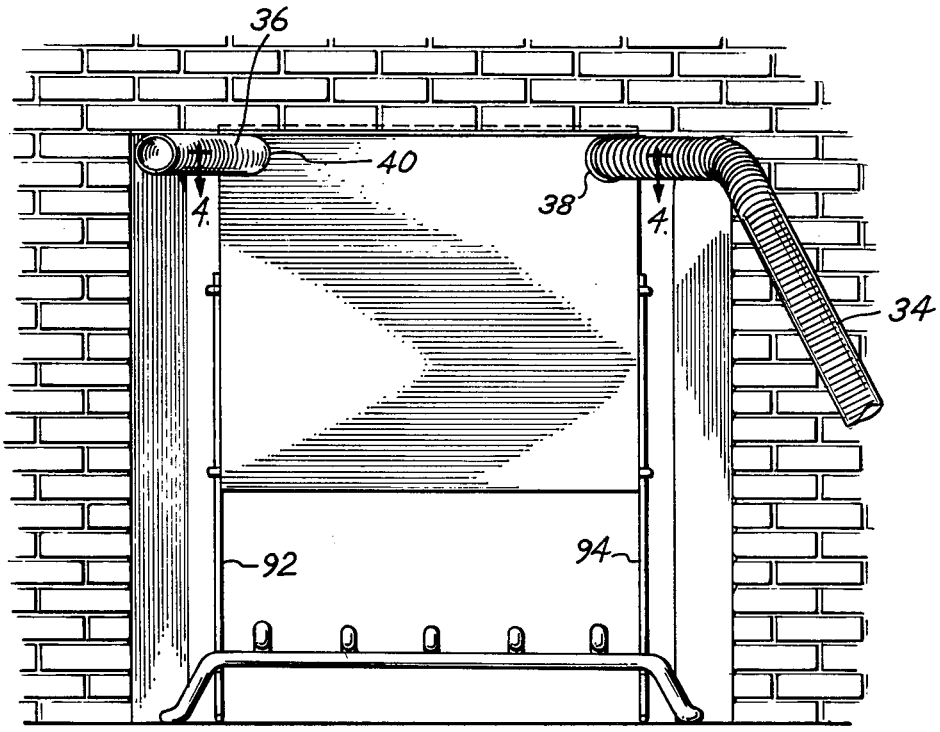
FIG. 3 is a front elevational view of the fireplace and heater shown in FIGS. 1 and 2.
Figure 4:
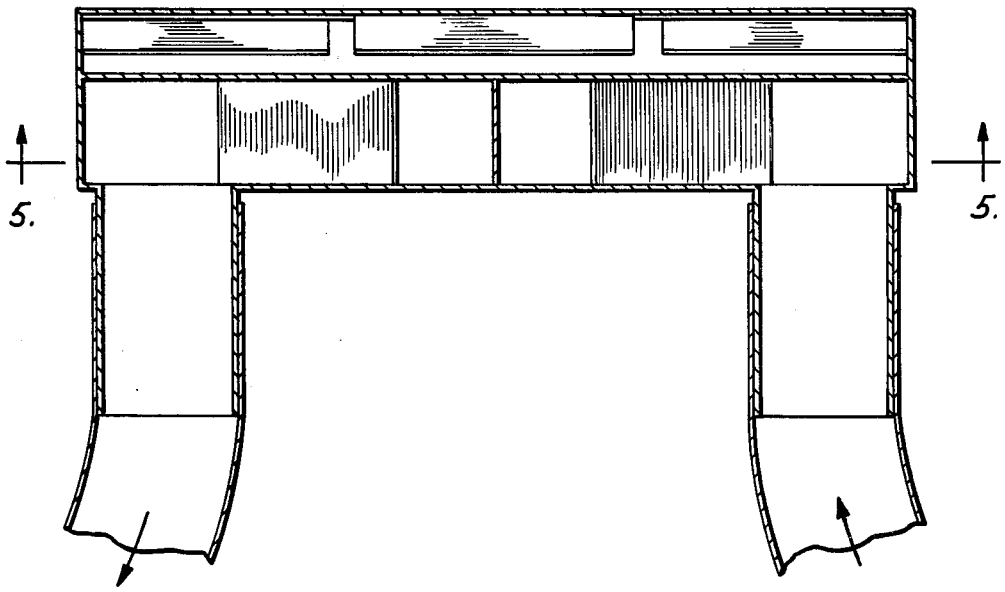
FIG. 4 is a horizontal cross sectional view of the present heater for use with the fireplace shown in the preceding figures, the section being taken on line 4—4 of FIG. 3.
Figure 5:
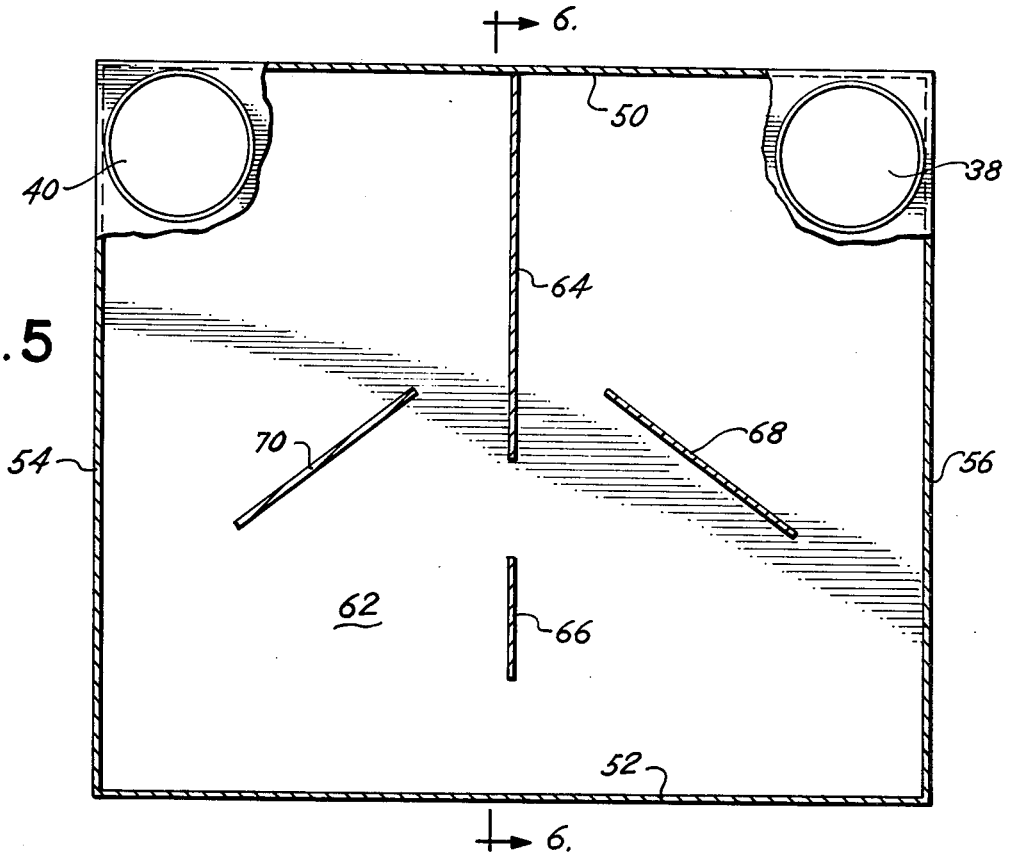
FIG. 5 is a vertical cross sectional view of the fireplace heater, the section being taken on line 5—5 of FIG. 4.
Figure 6:
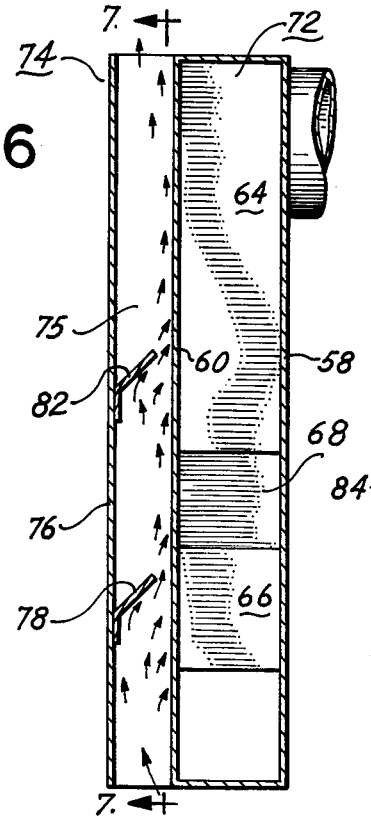
FIG. 6 is a vertical cross sectional view of the fireplace heater, the section being taken on line 6—6 of FIG. 5.
Figure 7:
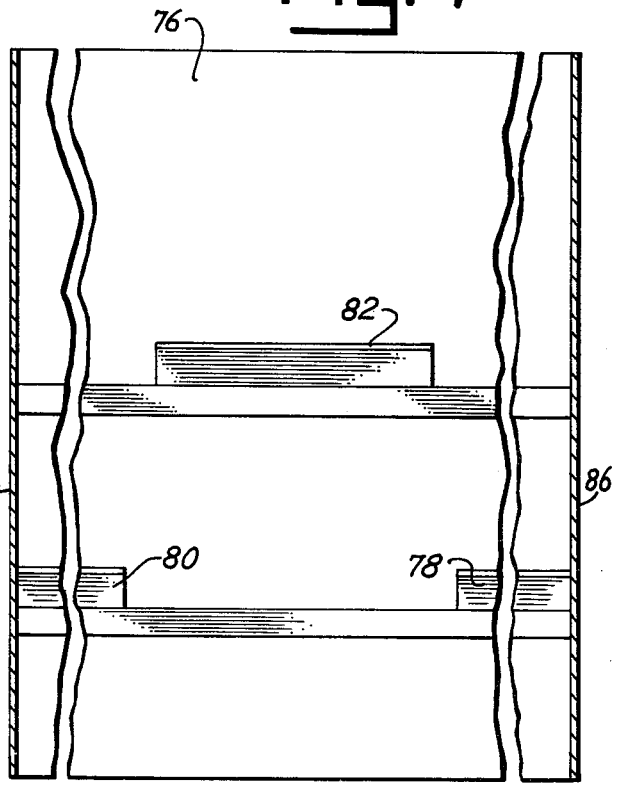
FIG. 7 is a vertical cross sectional view of the fireplace heater taken on line 7—7 of FIG. 6.

Referring more specifically to the drawings, numeral 10 indicates generally a conventional fireplace having firebox 12, hearth 14, face 16 and flue 18. A damper 20 is normally provided in the conventional fireplace, and a grate 22 is preferably used in the fireplace in which the present heater, indicated generally by numeral 30, is disposed. While the present fireplace space heater may be used with a variety of different types and designs of fireplaces, the one shown in the drawings is particularly suitable for operation with the present heater; however, the heater can be used with little or no change in many other fireplace types and designs.

The space heater 30 consists of a heat exchanger 32, a cold air inlet conduit 34 and a heated air conduit 36, the air inlet and outlet conduits preferably being of flexible metal tubing and entering the firebox through the upper right and left hand corners, respectively. However, either of the two conduits can be arranged to enter and exit the firebox at other locations, such as the lower right and left hand corners. Since the tubes are flexible, they can easily be shaped to follow various paths to and from the heat exchanger. The inlet conduit is connected to air inlet opening 38 in the upper right hand corner of the heat exchanger, and the air outlet conduit 36 is connected to air outlet opening 40 in the upper left hand corner of the heat exchanger. The air is forced through inlet conduit 34, into and through the heat exchanger, and out through conduit 36, by a blower or fan 42, preferably located away from the opening into the firebox, and in an inconspicuous location, possibly beside the fireplace. The heated air outlet conduit may terminate at the opening into the fireplace or, if desired, may extend beyond the opening and/or may include an air diffuser at the outlet thereof.

The heat exchanger consists of the bottom and top metal walls 50 and 52, side walls 54 and 56, and front and rear walls or panels 58 and 60. The top, bottom and side walls are joined to the edges of the front and rear panels 58 and 60 to form an air heating chamber 62 which communicates directly with air inlet opening 38 and air outlet opening 40. The chamber is provided with vertical baffles 64 and 66 and angular baffles 68 and 70 to cause the air entering opening 38 to pass through a circuitous path to reach outlet opening 40, thereby increasing the area of the inside surface of the walls to which the air flowing through the chamber is exposed, and thereby increasing the efficiency of the heat exchanger. One of the important features of the present invention is the effective utilization of the heated air and hot gases which normally pass upwardly along the back side of the firebox. In order to utilize this air effectively, the front section 72 of the heat exchanger is spaced outwardly from the rear wall and a section 74 with a heated air passageway 75, is disposed at the rear of panel 60, thereby permitting the rear panel 60 to absorb heat effectively from the heated air and gases passing upwardly through passage 75. Passage 75 is open at the top and bottom, and preferably has a rear wall 76 with a plurality of baffles 78, 80 and 82 mounted thereon for deflecting the flowing air in passage 75 toward the rear surface of panel 60. The rear section, consisting of rear wall 76 and side walls 84 and 86, is joined integrally to the front portion 72, thus forming a unitary heat exchanger structure. Passage 75 is preferably open completely across the unit at the top and bottom to give maximum air flow through the passage.

Another important feature of the present invention which permits the effective utilization of passage 75 is the positioning of the unit, preferably on legs or other supports 92 and 94, above the normal level of the fuel in the firebox which usually is disposed on a grate such as that shown at numeral 22. This permits the heated air and hot gases from the burning fuel to pass readily upwardly through passage 75 before they mix with cooler air entering the fireplace from the upper part of the fireplace opening. The legs shown in the drawings consist of rods secured by fixtures 96 and 98 to the side of the heat exchanger, and the heat exchanger may be adjustable by manipulating the fixtures to slip the rods or legs to various heights in the firebox relative to the grate or fuel thereon. The entire structure, including the front and rear section 72 and 74 and the legs, are preferably constructed of steel, such as heavy gauge sheet metal and rods, respectively; however, the legs may be of cast iron or steel if desired.

In the operation of the present fireplace space heater, the heat exchanger 32 is mounted at the rear of the firebox, normally with rear wall 76 resting against the wall of the firebox. The legs, which may be either permanently and fixedly secured to the sides of the heat exchanger or secured in a manner permitting vertical adjustment of the unit, support the unit in spaced relation to the support for the fuel, such as grate 22, so that the lower opening to passage 75 is as high and preferably higher than the normal upper level of the burning fuel in the firebox. The inlet conduit is then connected to air inlet 38, and the blower is preferably placed at the side of the fireplace, and the air outlet conduit is connected to air outlet 40 and preferably opens into the room at the upper left hand corner of the opening into the fireplace. Metal wire clips or other suitable attachment means may be required or desirable to retain the inlet and outlet conduits in the desired position with respect to the opening into the firebox.

When a fire has been started in the firebox, with damper 20 in open position, the heated air and hot gases from the fire pass upwardly along the front panel 58 and sides 54 and 56 and along bottom 52 of the front section 72, thereby heating these structures. At the same time, the hot gases pass upwardly through passage 75, thereby heating panel 60. As the fire burns, the blower, which is preferably driven by an electric motor forming an integral part of the blower, forces air through conduit 34 into chamber 62 where it circulates in passing from inlet 38 to outlet 40, and is heated both by convection and radiation, and is discharged through outlet conduit 36 into the room being heated. The blower continually circulates the air through the heat exchanger as long as heat in the room is desired over and above that normally provided directly by radiation from the fire in the fireplace.

In addition to the efficiency of the present fireplace heater, it can easily be inserted in the fireplace even after a fire has been started if desired, and can be readily removed from the fireplace if the fireplace is to be used solely in the conventional manner. It is also inconspicuous and requires no special fireplace structure in order to operate efficiently to use the hot gases and radiation from the fire most efficiently. In view of the efficiency of the unit, it can be relatively small and inconspicuous, the two conduits being the only portions readily observed from the room, and these conduits can be so placed with respect to the opening and the fuel in the fireplace that they do not detract from the appearance of the fireplace when they are in full operation.

While only one embodiment of the present space heater for fireplaces has been described in detail herein, various changes and modifications may be made to satisfy requirements.

We claim:

1. A space heater for use with a fireplace having a firebox with a rear wall, comprising a generally rectangularly shaped unit having metal walls forming a heat exchanger section with the front-to-rear thickness substantially less than the horizontal length, and defining an air flow chamber therein, leg means for supporting said heat exchanger section at a position above the normal height of the fuel in the firebox, means for holding said heat exchanger section in spaced relation to the back wall of the fireplace to provide a passageway for hot gases and smoke on the rear side of the heat exchanger, said last mentioned means having two side walls joined to said heat exchanger section and a rear wall connecting said two side walls to form a rear section having a vertical passageway therein adjacent the rear wall of the heat exchanger section, and a plurality of baffles disposed in said passageway for directing the hot gases into contact with the rear wall of the heat exchanger section, an air inlet to said chamber adjacent one of the upper front corners of said unit, a flexible tubular conduit extending forwardly from said inlet to the front of the fireplace, an air outlet from said chamber adjacent the other upper front corner of said unit, a flexible tubular conduit extending forwardly from said outlet to the front of the fireplace for connecting said air outlet with the space to be heated, and a means for circulating the air from said air inlet conduit, through said chamber and to and through the air outlet conduit.

2. A space heater for use with a fireplace as defined in claim 1 in which baffles are disposed in said air flow chamber to form an circuitous path between said air inlet to said chamber and said air outlet from said chamber.

3. A space heater for use with a fireplace as defined in claim 1 in which said leg means for supporting said heat exchanger section are attached to said unit.

4. A space heater for use with a fireplace as defined in claim 3 in which said leg means are attached to the side walls of said unit and means is provided for adjusting said unit vertically.

* * * * *